US008932107B2

(12) United States Patent
David et al.

(10) Patent No.: US 8,932,107 B2
(45) **Date of Patent: *Jan. 13, 2015**

(54) GATHERING SPECTRA FROM MULTIPLE OPTICAL HEADS

(71) Applicant: Applied Materials, Inc., Santa Clara, CA (US)

(72) Inventors: Jeffrey Drue David, San Jose, CA (US); Boguslaw A. Swedek, Cupertino, CA (US); Dominic J. Benvegnu, La Honda, CA (US); Sivakumar Dhandapani, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/027,070

(22) Filed: Sep. 13, 2013

(65) Prior Publication Data

US 2014/0011429 A1 Jan. 9, 2014

Related U.S. Application Data

(63) Continuation of application No. 13/016,504, filed on Jan. 28, 2011, now Pat. No. 8,535,115.

(51) Int. Cl.
*B24B 1/00* (2006.01)
*B24B 49/12* (2006.01)
(Continued)

(52) U.S. Cl.
CPC ..... *B24B 49/12* (2013.01); *B24B 37/013* (2013.01); *B24B 37/105* (2013.01)
USPC ..... 451/6; 451/5; 451/41; 451/287; 451/289

(58) Field of Classification Search
CPC ..... B24B 37/013; B24B 37/105; B24B 49/12
USPC ..... 451/5, 6, 287, 289, 41
See application file for complete search history.

(56) References Cited

U.S. PATENT DOCUMENTS 5,871,391 A 2/1999 Pryor
5,993,289 A 11/1999 Allen et al.
6,012,965 A 1/2000 Savoie
(Continued)

FOREIGN PATENT DOCUMENTS

JP 2001-009699 1/2001

OTHER PUBLICATIONS

International Search Report and written Opinion dated Aug. 31, 2012 from corresponding application PCT/US2012/021135.

*Primary Examiner* — George Nguyen
(74) *Attorney, Agent, or Firm* — Fish & Richardson P.C.

(57) ABSTRACT

A polishing apparatus includes a platen to hold a polishing pad having a plurality of optical apertures, a carrier head to hold a substrate against the polishing pad, a motor to generate relative motion between the carrier head and the platen, and an optical monitoring system. The optical monitoring system includes at least one light source, a common detector, and an optical assembly configured to direct light from the at least one light source to each of a plurality of separated positions in the platen, to direct light from each position of the plurality of separated positions to the substrate as the substrate passes over said each position, to receive reflected light from the substrate as the substrate passes over said each position, and to direct the reflected light from each of the plurality of separated positions to the common detector.

13 Claims, 3 Drawing Sheets

(51) Int. Cl.
*B24B 37/013* (2012.01)
*B24B 37/10* (2012.01)

(56) References Cited

U.S. PATENT DOCUMENTS

| | | | | |
|---|---|---|---|---|
| 6,190,234 | B1 | 2/2001 | Swedek et al. | |
| 6,491,569 | B2 | 12/2002 | Bibby et al. | |
| 6,648,730 | B1 | 11/2003 | Chokshi et al. | |
| 7,030,380 | B2 * | 4/2006 | Boyle et al. | 250/339.11 |
| 7,481,945 | B2 | 1/2009 | Matsukawa | |
| 7,614,936 | B2 | 11/2009 | Benvegnu et al. | |
| 8,393,933 | B2 | 3/2013 | Qian et al. | |
| 8,535,115 | B2 | 9/2013 | David et al. | |
| 2004/0027586 | A1 * | 2/2004 | Ichikawa et al. | 356/614 |
| 2004/0058621 | A1 | 3/2004 | Wiswesser et al. | |
| 2005/0173259 | A1 | 8/2005 | Mavliev et al. | |
| 2007/0042675 | A1 | 2/2007 | Benvegnu et al. | |
| 2007/0073157 | A1 * | 3/2007 | Sendai | 600/473 |
| 2008/0099443 | A1 | 5/2008 | Benvegnu et al. | |
| 2008/0102734 | A1 | 5/2008 | Benvegnu et al. | |
| 2009/0036026 | A1 | 2/2009 | David et al. | |
| 2009/0275265 | A1 | 11/2009 | Qian et al. | |
| 2009/0318061 | A1 | 12/2009 | Taylor et al. | |
| 2010/0037695 | A1 * | 2/2010 | Tsujita et al. | 73/587 |
| 2010/0124870 | A1 | 5/2010 | Benvegnu et al. | |
| 2010/0184357 | A1 * | 7/2010 | Qian et al. | 451/6 |
| 2010/0217430 | A1 | 8/2010 | David et al. | |
| 2011/0171883 | A1 * | 7/2011 | Allison et al. | 451/6 |
| 2011/0256818 | A1 * | 10/2011 | Swedek et al. | 451/540 |
| 2011/0281510 | A1 * | 11/2011 | Swedek et al. | 451/527 |
| 2011/0287694 | A1 | 11/2011 | Benvegnu et al. | |

* cited by examiner

GATHERING SPECTRA FROM MULTIPLE OPTICAL HEADS

CROSS-REFERENCE TO RELATED APPLICATIONS

This application is a continuation application of and claims priority to U.S. application Ser. No. 13/016,504, filed on Jan. 28, 2011.

TECHNICAL FIELD

The present disclosure relates to optical monitoring, e.g., during chemical mechanical polishing of substrates.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, such as a slurry with abrasive particles, is typically supplied to the surface of the polishing pad.

One problem in CMP is determining whether the polishing process is complete, i.e., whether a substrate layer has been planarized to a desired flatness or thickness, or when a desired amount of material has been removed. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, it may not be possible to determine a desired polishing endpoint merely as a function of polishing time.

In some systems, a substrate is optically monitored in-situ during polishing, e.g., through a window in the polishing pad. However, existing optical monitoring techniques may not satisfy increasing demands of semiconductor device manufacturers.

SUMMARY

In some optical monitoring processes, a spectrum of a substrate is measured in-situ, e.g., during the polishing processes, by directing light through a window in a polishing pad supported on a platen. If the platen rotates, then the window can pass below the substrate once per rotation. However, for some polishing operations, e.g., where the rotation rate is low or overpolishing needs to be avoided, measuring a spectrum once per rotation of the platen provides insufficient data to halt polishing with a desired precision. By collecting spectra from multiple locations at different angular positions around the platen, the rate of collection of spectra can be increased. In addition, by using a single light source and a single spectrometer, problems of calibrating multiple sensing systems can be avoided.

In one aspect, a polishing apparatus includes a platen to hold a polishing pad having a plurality of optical apertures, a carrier head to hold a substrate against the polishing pad, a motor to generate relative motion between the carrier head and the platen, and an optical monitoring system. The optical monitoring system includes at least one light source, a common detector, and an optical assembly configured to direct light from the at least one light source to each of a plurality of separated positions in the platen, to direct light from each position of the plurality of separated positions to the substrate as the substrate passes over said each position, to receive reflected light from the substrate as the substrate passes over said each position, and to direct the reflected light from each of the plurality of separated positions to the common detector.

Implementations can include one or more of the following features. The platen may be rotatable about an axis of rotation. The plurality of separated positions may be spaced equidistant from the axis of rotation. The plurality of separated positions may be spaced at equal angular intervals around the axis of rotation. The optical assembly may be configured such that an angle of incidence of the light from said each position on the substrate is identical. The plurality of separated positions may consist of exactly two positions or three positions.

The at least one light source may be a common light source. The optical assembly may include a bifurcated optical fiber having a trunk connected to the common light source and a plurality of branches, and each branch of the plurality of branches may be configured to direct light to an associated position of the plurality of positions. The optical assembly may include a first bifurcated optical fiber having a first trunk connected to the common light source and a plurality of first branches and a second bifurcated optical fiber having a second trunk connected to the common detector and a second plurality of branches. Each first branch of the plurality of first branches may configured to direct light to an associated position of the plurality of positions, and each branch of the plurality of second branches may be configured to receive light from an associated position of the plurality of positions. The apparatus may include an optical probe at each position of the plurality of separated positions, and each first branch from the plurality of first branches and each second branch from the plurality of second branches may be optically coupled to an associated optical probe.

The optical assembly may include a bifurcated optical fiber having a trunk connected to the common detector and a plurality of branches, and each branch of the plurality of branches may be configured to receive light from an associated position of the plurality of positions. The at least one light source may include a plurality of light sources. Each light source of the plurality of light sources may be associated with a different position of the plurality of positions. The optical assembly may include a plurality of optical fibers, each optical fiber of the plurality of optical fibers having a first end connected to a light source of the plurality of light sources and a second end configured to direct light to an associated position of the plurality of positions. The optical assembly may include a bifurcated optical fiber having a trunk connected to the common detector and a plurality of branches, and each branch of the plurality of branches may be configured to receive light from the associated position of the plurality of positions.

The at least one light source may be a white light source and the detector may be a spectrometer. A plurality of optical shutters may be disposed in light paths from the plurality of positions to the common detector, and a controller may be configured to open one selected optical shutter of the plurality of optical shutters. The controller may be configured to open the one selected optical shutter of the plurality of optical shutters corresponding to a position adjacent the substrate. An optical switch may be configured to pass light from a selected one of the plurality of positions to the detector. The platen may be configured such that relative motion between the carrier head and the platen causes each position of the plurality of separated positions to repeatedly sweep across the substrate. A controller may be configured to receive a group of spectrum measurements from the detector for each sweep of each position across the substrate. The controller may be configured to generate a spectrum in a sequence of spectra from the group of spectrum measurements. The platen may be rotatable, and the controller may be configured to add a number of spectra to the sequence for each rotation of the platen, the number being equal to the number of the plurality of separate positions. The controller may be configured to determine at least one of a polishing endpoint or an adjustment to a polishing parameter based on the sequence of spectra.

In another aspect, a method of operating an optical monitoring system includes holding a substrate against a polishing pad supported by a platen, generating relative motion between the platen and the substrate, directing light from at least one light source to each of a plurality of separate positions in the platen, the relative motion causing the plurality of separate positions to sweep across the substrate, directing light from each position of the plurality of separated positions to the substrate as the substrate passes over said each position, receiving reflected light from the substrate as the substrate passes over said each position, and directing the reflected light from each of the plurality of separated positions to a common detector.

In another aspect, a computer program product, tangibly embodied in a machine readable storage device, includes instructions to carry out the method.

Implementations may optionally include one or more of the following advantages. The rate of collection of spectra may be increased, and polishing may be halted with greater precision. Reliability of the endpoint system to detect a desired polishing endpoint can be improved, and within-wafer and wafer-to-wafer thickness non-uniformity (WIWNU and WTWNU) can be reduced. In addition, by using a single light source and a single spectrometer, problems of calibrating multiple sensing systems can be avoided.

The details of one or more embodiments are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
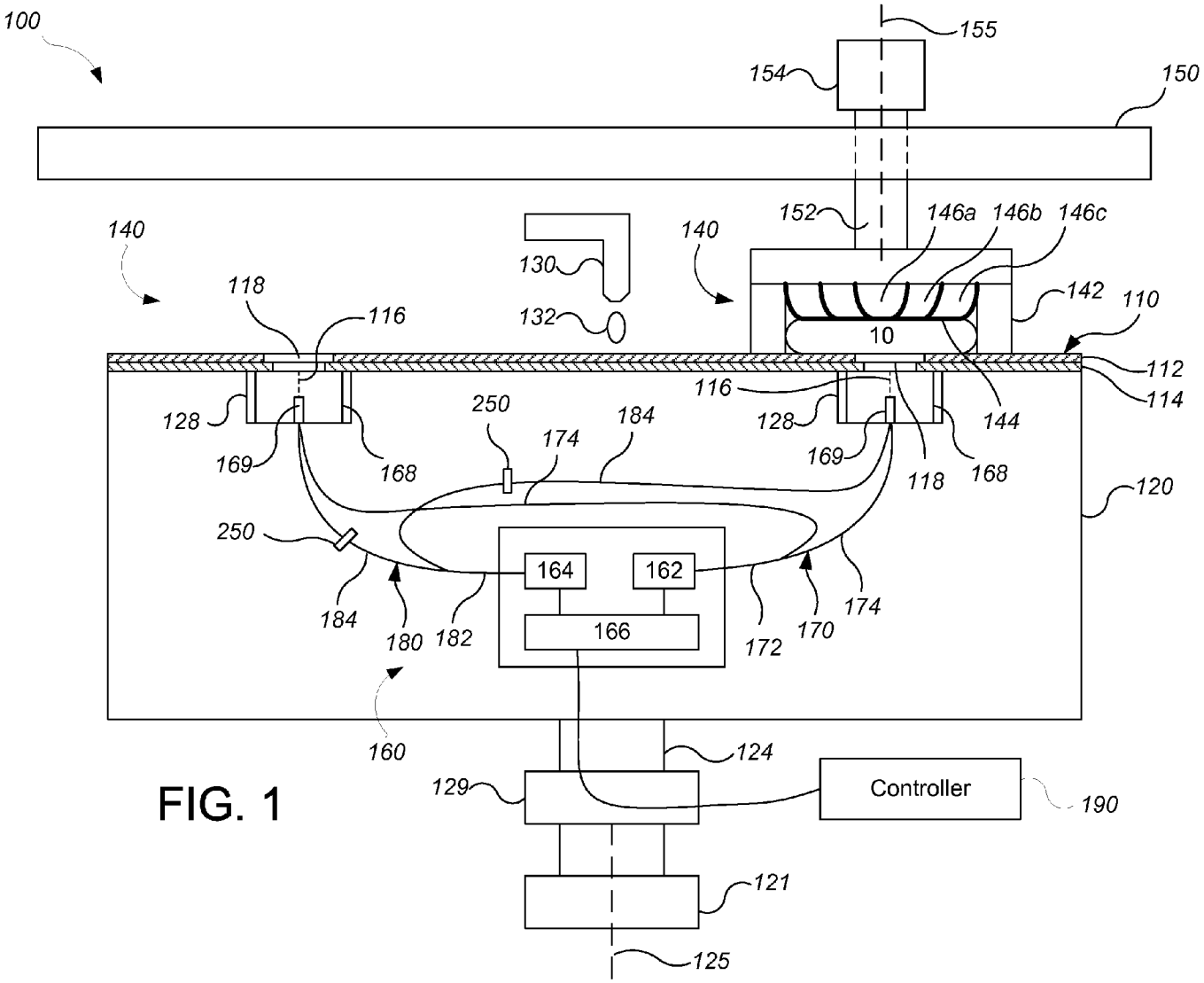
FIG. 1 illustrates a schematic cross-sectional view of an example of a polishing apparatus.

FIG. 1 illustrates an example of a polishing apparatus 100. The polishing apparatus 100 includes a rotatable disk-shaped platen 120 on which a polishing pad 110 is situated. The platen is operable to rotate about an axis of rotation 125. For example, a motor 121 can turn a drive shaft 124 to rotate the platen 120. The polishing pad 110 can be a two-layer polishing pad with an outer polishing layer 112 and a softer backing layer 114.

The polishing apparatus 100 can include a port 130 to dispense polishing liquid 132, such as a slurry, onto the polishing pad 110. The polishing apparatus can also include a polishing pad conditioner to abrade the polishing pad 110 to maintain the polishing pad 110 in a consistent abrasive state.

The polishing apparatus 100 includes one or more carrier heads 140. Each carrier head 140 is operable to hold a substrate 10 against the polishing pad 110. The polishing parameter for each carrier head 140, for example pressure applied to an associate substrate, can be independently controlled.

Figure 2:
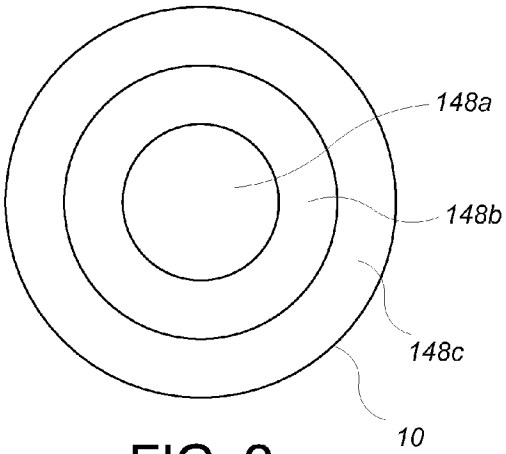
FIG. 2 illustrates a schematic top view of a substrate having multiple zones.

In particular, each carrier head 140 can include a retaining ring 142 to retain the substrate 10 below a flexible membrane 144. Each carrier head 140 also includes a plurality of independently controllable pressurizable chambers defined by the membrane, e.g., 3 chambers 146*a*-146*c*, which can apply independently controllable pressurizes to associated zones on the flexible membrane 144 and thus on associated zones 148*a*-148*c* the substrate 10 (see FIG. 2). Referring to FIG. 2, the center zone 148*a* can be substantially circular, and the remaining zones 148*b*-148*e* can be concentric annular zones around the center zone 148*a*. Although only three chambers are illustrated in FIGS. 1 and 2 for ease of illustration, there could be one or two chambers, or four or more chambers, e.g., five chambers.

Returning to FIG. 2, each carrier head 140 is suspended from a support structure 150, e.g., a carousel, and is connected by a drive shaft 152 to a carrier head rotation motor 154 so that the carrier head can rotate about an axis 155. Optionally each carrier head 140 can oscillate laterally, e.g., on sliders on the carousel 150; or by rotational oscillation of the carousel itself. In operation, the platen is rotated about its axis of rotation 125, and each carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently. Thus, the number of carrier head assemblies adapted to hold substrates for a simultaneous polishing process can be based, at least in part, on the surface area of the polishing pad 110.

The polishing apparatus also includes an in-situ optical monitoring system 160, e.g., a spectrographic monitoring system, which can be used to determine a polishing endpoint or whether to adjust a polishing rate.

Returning to FIG. 1, the optical monitoring system 160 can include a light source 162, a light detector 164, and circuitry 166 for sending and receiving signals between a remote controller 190, e.g., a computer, and the light source 162 and light detector 164. The optical monitoring system 160 is configured to monitor the substrate from a plurality of separated positions 116 on the platen 120.

The in-situ optical monitoring 160 includes an optical assembly configured to direct light from the light source 162 to each of the plurality of positions 116 in the platen, to direct light from each of the plurality of positions 116 to the substrate 10 as the substrate 10 passes over each position 116, to receive reflected light from the substrate 10 as the substrate 10 passes over said each position 116, and to direct reflected light from each of the plurality of positions 116 to the detector 164. Thus, the same light source and the same detector are used for monitoring at each position 116 (the term "common" as used herein refers to the sharing of the light source or detector for monitoring at multiple positions, not to the light source or detector being ordinary or conventional). In some implementations, only one position 116 is below the substrate at a given time.

The plurality of positions 116 can be located at the same radius R from the axis of rotation 125 of the platen 120. However, in some implementations, the positions 116 are located different distances from the axis of rotation 125. In addition, the plurality positions 116 can be spaced at equal angular intervals A around the axis of rotation 125 of the platen 120. However, in some implementations, the positions 116 are spaced at different angular intervals around the axis of rotation 125. In one implementation, shown in FIG. 3, the optical assembly directs the light to exactly three positions 116 spaced apart by an angular interval A of 120°. In another implementation, shown in FIG. 2, the optical assembly directs the light to exactly four positions 116 spaced apart by an angular interval A of 180°. In another implementation, the optical assembly directs the light to exactly two positions 116 spaced apart by an angular interval A of 90°. In addition, the optical assembly could direct the light to four or more positions.

A probe, e.g., the end of an optical fiber, can be located at each of the plurality of positions 116. Each probe can be configured to direct light to and receive reflected light from the substrate 10 as the substrate 10 passes over the probe.

A probe, e.g., the end of an optical fiber, can be located at each of the plurality of positions 118. Each probe can be configured to direct light to and receive reflected light from the substrate 10 as the substrate 10 passes over the probe.

A plurality of optical accesses 118 through the polishing pad 110 are provided for the optical monitoring system 160 to monitor the substrate 10. An optical access 118 through the polishing pad can be located at each of the plurality of positions 116. Each optical access 118 can be located at one of the plurality of positions 116. The optical accesses 118 can be apertures (i.e., holes that runs through the pad) or solid windows in the polishing pad 110. A solid window can be secured to the polishing pad 110, e.g., as a plug that fills an aperture in the polishing pad, e.g., is molded to or adhesively secured to the polishing pad, although in some implementations the solid window can be supported on the platen 120 and project into an aperture in the polishing pad.

Figure 3:
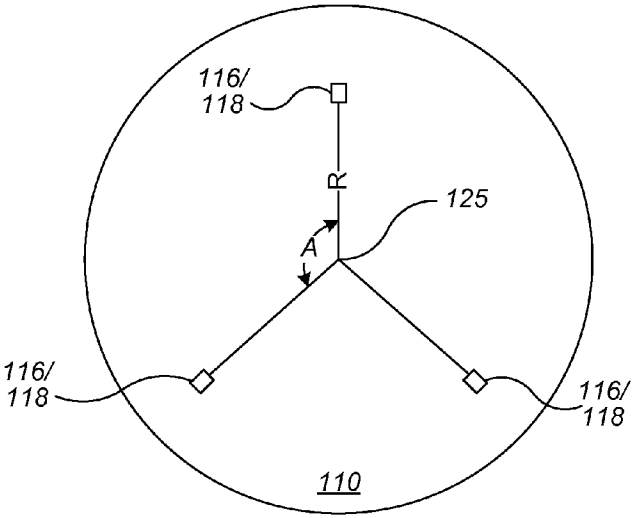
FIG. 3 illustrates a top view of a polishing pad having multiple windows.

Referring to FIG. 3, the optical accesses 118 through the polishing pad 110 can be located at the same radius R from the axis of rotation 125 of the platen 120. In addition, the optical accesses 118 through the polishing pad 110 can be spaced at equal angular intervals A around the axis of rotation 125 of the platen 120.

The optical assembly can include a plurality of optical fibers. The plurality of optical fibers can be used to transmit the light from the common light source 162 to each optical access 118 in the polishing pad, and to transmit light reflected from the substrate 10 at each optical access 118 to the detector 164. For example, a first bifurcated optical fiber 170 can be used to transmit the light from the light source 162 to each of the optical accesses 118, and a second bifurcated optical fiber 180 can be used to transmit the light from the substrate 10 back to the detector 164. The first bifurcated optical fiber 170 can include a trunk 172 connected to the light source 162, and a plurality of branches 174 (equal to the number of optical accesses). The end of each branch 174 is positioned in proximity to an associated optical access 118 to optically couple the branch 174 to the associated optical access 118. Similarly, the second bifurcated optical fiber 180 can include a trunk 182 connected to the detector 164, and a plurality of branches 184 (equal to the number of optical accesses). The end of each branch 184 is positioned in proximity to an associated optical access to optically couple the branch 184 to the associated optical access 118. Consequently, all of the optical accesses 118 can receive light from a common light source 162, and a common detector 164 receives the light from all of the optical accesses 118.

In some implementations, the top surface of the platen can include a plurality of recesses 128 into which optical heads 168 are fit. Each optical head 168 is vertically aligned with one of the optical accesses 118. Each optical head 168 holds an end of an associated branch 174 of the first bifurcated optical fiber 170, and holds an end of an associated branch 184 of the second bifurcated optical fiber 180. The optical head 168 can optionally include a light pipe or optical fiber 169 to which the end of the branch 174 of the first bifurcated optical fiber 170 and the end of the branch 184 of the second bifurcated optical fiber 170 are coupled. Thus, the light pipe or optical fiber 169 can serve to transmit light from the first optical fiber 170 to the optical access 118, and transmit light from the optical access to the second optical fiber 180. The optical head can include a mechanism to adjust the vertical position of the top of the light pipe or optical fiber 169, or the vertical position of the ends of the branches 174 and 184, relative to the top surface of the platen. Thus, if a solid window is used, the mechanism can set the vertical distance between the top of the light pipe or optical fiber 169, or the vertical position of the ends of the branches 174 and 184, and the solid window.

The optical heads 168 (and the ends of the branches 174 and 184 of the first and second bifurcated optical fibers 170 and 180), are positioned in the platen in a manner similar to the optical accesses 118. Thus, each optical head 168 (and the end of each branch 174 of the first bifurcated optical fiber 170 and the end of each branch 184 of the second bifurcated optical fiber 180) can be located at the same radius R from the axis of rotation 125 of the platen 120. In addition, each optical head 168 (and the end of each branch 174 of the first bifurcated optical fiber 170 and the end of each branch 184 of the second bifurcated optical fiber 180) can be spaced at equal angular intervals A around the axis of rotation 125 of the platen 120. In one implementation, there are exactly three optical heads 168 (and exactly three branches 174 of the first bifurcated optical fiber 170 with ends and exactly three branches 184 of the second bifurcated optical fiber 180 with ends) spaced apart by an angular interval A of 120°. In another implementation, shown in FIG. 2, the polishing pad includes exactly two optical heads 168 (and exactly two branches 174 of the first bifurcated optical fiber 170 with ends and exactly two branches 184 of the second bifurcated optical fiber 180 with ends) spaced apart by an angular interval A of 180°.

The optical assembly can be configured so that the angle of incidence of the light onto the substrate is identical at each position 116, e.g., the angle of incidence can be zero (so that the light beam is perpendicular to the surface of the substrate).

For example, the ends of the branches 174 and 184 of the optical fibers 170 and 180 can be held by the optical heads 168 to be perpendicular to the top surface of the platen 120. In addition, any light modifying elements in the optical paths from the light source 162 to the positions 116, and from the positions 116 to the detector 142 should be identical, so that the same wavelength range is used for the spectral measurement at each position 116.

The output of the circuitry 166 can be a digital electronic signal that passes through a rotary coupler 129, e.g., a slip ring, in the drive shaft 124 to the controller 190 for the optical monitoring system. Similarly, the light source can be turned on or off in response to control commands in digital electronic signals that pass from the controller 190 through the rotary coupler 129 to the optical monitoring system 160. Alternatively, the circuitry 166 could communicate with the controller 190 by a wireless signal.

The light source 162 can be operable to emit white light. In one implementation, the white light emitted includes light having wavelengths of 200-800 nanometers. A suitable light source is a xenon lamp or a xenon mercury lamp.

The light detector 164 can be a spectrometer. A spectrometer is an optical instrument for measuring intensity of light over a portion of the electromagnetic spectrum. A suitable spectrometer is a grating spectrometer. Typical output for a spectrometer is the intensity of the light as a function of wavelength (or frequency).

As noted above, the light source 162 and light detector 164 can be connected to a computing device, e.g., the controller 190, operable to control their operation and receive their signals. The computing device can include a microprocessor situated near the polishing apparatus, e.g., a programmable computer. With respect to control, the computing device can, for example, synchronize activation of the light source with the rotation of the platen 120.

The rotation of the platen will cause each optical access 118 to scan across the substrate 10. As the platen 120 rotates, the controller 190 can cause the light source 162 to emit light continuously or in series of flashes, and to emit light starting just before and ending just after one of the optical accesses passes below the substrate 10 or for the entire rotation of the platen. In any of these cases, the signal from the detector 164 can be integrated over a sampling period to generate spectra measurements at a sampling frequency.

As shown by in FIG. 4, due to the rotation of the platen (shown by arrow 204), each time an optical access 118 travels below a carrier head, the optical monitoring system makes spectra measurements at a sampling frequency. This causes a group of spectra measurements to be taken at locations 201 that sweep across the substrate 10, e.g., in an arc. That is, a group of spectra corresponds to a single sweep of a single optical access 118 across the substrate 10. For example, each of points 201*a*-201*k* represents a location of a spectrum measurement by the monitoring system (the number of points is illustrative; more or fewer measurements can be taken than illustrated, depending on the sampling frequency). The sampling frequency can be selected so that between five and twenty spectra are collected per sweep of an optical access 118 across the substrate. For example, the sampling period can be between 1 and 100 milliseconds.

Figure 4:
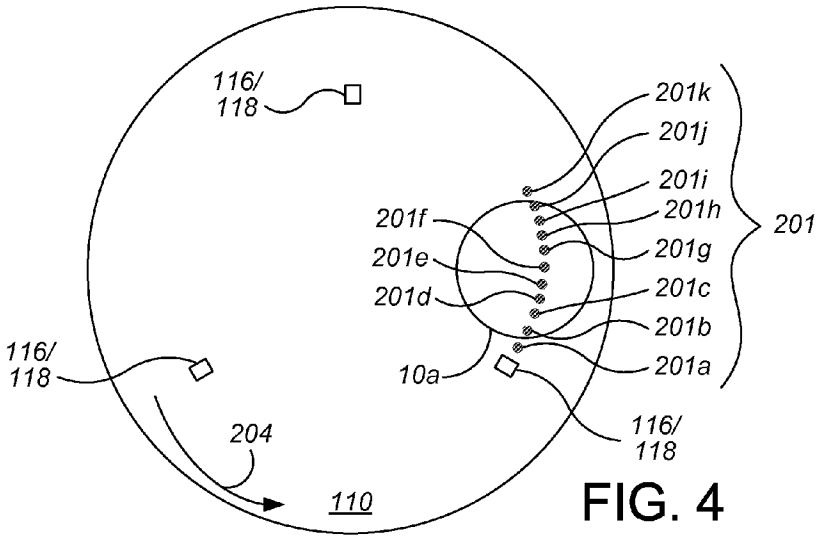
FIG. 4 illustrates a top view of a polishing pad and shows locations where in-situ measurements are taken on a substrate.

Although FIG. 4 only shows the points on the substrate measured when one of the optical accesses traverses the substrate 10, other groups of spectra measurements will be taken when the other optical accesses traverse the substrate. Consequently, a number of groups of spectra measurements equal to the number of optical accesses 118 are generated for each platen rotation. Over multiple rotations of the platen, multiple groups of spectra measurements are obtained.

In operation, the controller 190 can receive, for example, a signal from circuitry 166 that carries information describing the spectrum of the light received by the light detector for a particular flash of the light source or time frame of the detector. Thus, this spectrum is a spectrum measured in-situ during polishing. Without being limited to any particular theory, the spectrum of light reflected from the substrate 10 evolves as polishing progresses (e.g., over multiple rotations of the platen, not during a single sweep across the substrate) due to changes in the thickness of the outermost layer, thus yielding a sequence of time-varying spectra. Moreover, particular spectra are exhibited by particular thicknesses of the layer stack.

A sequence of spectra is generated from the multiple groups of spectra measurements. The sequence of spectra can have one spectrum per group of spectra measurements, e.g., one spectrum per sweep of an optical accesses 118 across the substrate. Thus, each platen rotation the number of spectra in the sequence will increase by the number of groups of spectra measurements collected for that platen rotation. In some implementations, where (termed "current spectra"), a best match can be determined between each spectrum of the group of spectrum measurements and one or more reference spectra, e.g., a plurality of reference spectra from one or more libraries. Whichever reference spectrum provides the best match, e.g., has the smallest sum of squares difference, can provide the next spectrum in the sequence. Alternatively, whichever spectrum from the group of spectrum measurements provides the best match, e.g., has the smallest sum of squares difference, can be selected to provide the next spectrum in the sequence. In some implementations, the spectra from the group of spectrum measurements can be combined, e.g., averaged, and the resulting combined spectrum can then be used as the next spectrum in the sequence, or be compared against the reference spectra to determine the best matching reference spectrum which is used as the next spectrum in the sequence.

Thus, over multiple rotations of the platen, a sequence of spectra is obtained. The controller 190 can then analyze this sequence of spectra in order to determine a polishing endpoint, e.g., as described in U.S. Patent Application Publication Nos. 2010-0217430 or 2008-0099443, which are incorporated by reference.

Due to the multiple optical accesses 118 and the collection of multiple groups of spectrum measurements per rotation of the platen, spectra are added to the sequence at a greater rate than if a single optical access 118 is used, e.g., twice the rate if two optical accesses 118 are used, or three times the frequency if three optical accesses 118 are used. The addition of spectra to the sequence at a higher rate permits polishing to be halted with greater precision.

In some implementations, multiple sequences of spectra can be generated, e.g., multiple sequences that correspond to the controllable zones on the substrate. As shown, over one rotation of the platen, spectra are obtained from different radii on the substrate 10. That is, some spectra are obtained from locations closer to the center of the substrate 10 and some are closer to the edge. Thus, for any given scan of the optical monitoring system across a substrate, based on timing, motor encoder information, and optical detection of the edge of the substrate and/or retaining ring, the controller 190 can calculate the radial position (relative to the center of the substrate being scanned) for each measured spectrum from the scan. The polishing system can also include a rotary position sensor, e.g., a flange attached to an edge of the platen that will pass through a stationary optical interrupter, to provide additional data for determination of which substrate and the position on the substrate of the measured spectrum. The controller 190 can thus associate the various measured spectra with the controllable zones 148*b*-148*e* (see FIG. 2) on the substrates 10*a* and 10*b*. In some implementations, the time of measurement of the spectrum can be used as a substitute for the exact calculation of the radial position.

Over multiple rotations of the platen, a sequence of spectra can be obtained over time for each zone. The controller 190 can then analyze these sequences of spectra in order to adjust a polishing parameter, e.g., pressure in one of the chambers of the carrier head, in order to achieve greater polishing uniformity or cause multiple regions of the substrate to reach endpoint closer, e.g., as described in U.S. Patent Application Publication No. 2010-0217430, which is incorporated by reference.

Returning to FIG. 1, in some implementations, the light from the optical accesses 118 is multiplexed such that only light from the optical access positioned directly below the substrate 10 is passed to the detector 164. For example, an optical shutter 250, e.g., a liquid crystal shutter or a mechanical shutter, can be inserted into each branch 184 of the second bifurcated optical fiber 180. Each optical shutter 250 can be controlled by the controller 190 to open starting just before the optical access 118 associated with the branch 184 in which the optical shutter 250 is placed passes below the substrate 10, and to close just after that optical access 118 passes below the substrate 10. Although illustrates as being in the branch 184, the optical shutter could be located at the end of the branch 184, e.g., in or just before the optical head 168. In addition, the optical shutter could also extend across the end of the branch 174 of the first bifurcated optical fiber 170, so that when the optical shutter is closed, light from the light source 162 does not exit through the optical access 118. As another example, rather than a bifurcated optical fiber, an optical switch could be used to connect an optical fiber from each of the optical accesses 118 to a single optical fiber that is connected to the detector 164. The switch can be controlled so that only light from the optical access positioned below the substrate 10 is passed to the detector 164. By preventing light from the other optical accesses 118 from reaching the detector 164, stray light input to the detector 164 can be reduced, signal strength can be increased, and reliability of the optical endpoint detection algorithm can be improved. However, in some implementations, e.g., if the signal strength is sufficiently strong, no shutter is used.

Figure 5:
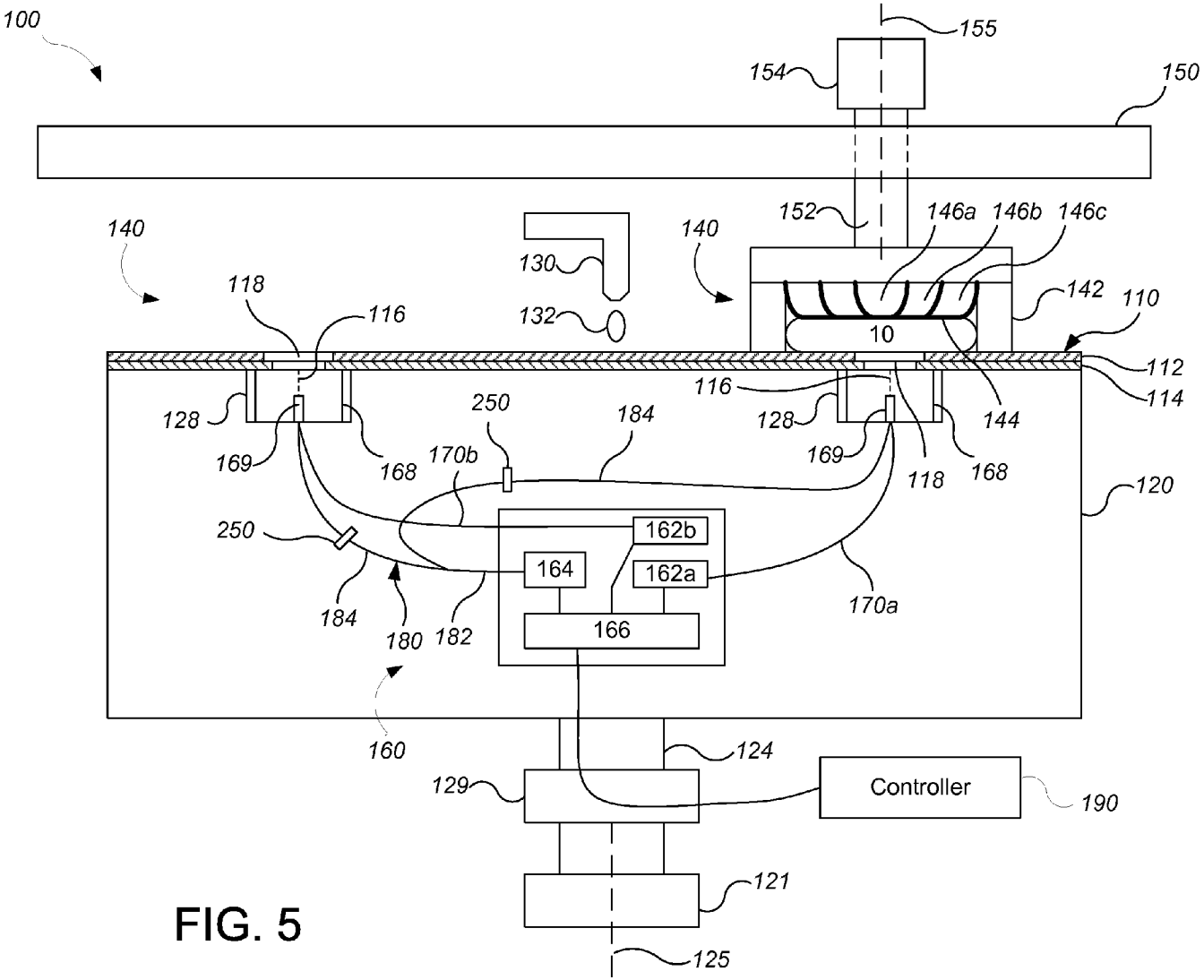
FIG. 5 illustrates a measured spectrum from the in-situ optical monitoring system.

Referring to FIG. 5, the optical monitoring system 160 can include multiple light source 162*a*, 162*b* rather than a common light source. In this case, there can be a light source for each of the plurality of positions 116 in the platen. The in-situ optical monitoring 160 includes an optical assembly configured to direct light from each light source 162*a*, 162*b* to an associated position of the plurality of positions 116 in the platen, to direct light from each of the plurality of positions 116 to the substrate 10 as the substrate 10 passes over each position 116, to receive reflected light from the substrate 10 as the substrate 10 passes over said each position 116, and to direct reflected light from each of the plurality of positions 116 to the detector 164. Thus, the same detector but different light sources are used for monitoring at each position 116. Each light source 162*a*, 162*b* can otherwise be identical, e.g., each can be a xenon or xenon mercury. Each light source 162*a*, 162*b* can output substantially the same spectrum so that the same wavelength range is used for the spectral measurement at each position 116.

A plurality of optical fibers 170*a*, 170*b* can direct light from the plurality of light sources 162*a*, 162*b* to the positions 116. Each optical fiber of the plurality of optical fibers has a first end connected to an associated light source of the plurality of light sources 162*a*, 162*b*, and a second end configured to direct light to an associated position of the plurality of positions 116. For example, a first optical fiber 170*a* can transmit the light from a first light source 162*a* to a first optical accesses 118, and a second optical fiber 170*b* can transmit the light from a second light source 162*b* to a second optical access 118. A bifurcated third optical fiber 180 can be used to transmit the light from the substrate 10 from each of the optical accesses 118 back to the detector 164.

Rather than a rotating platen with an optical endpoint monitor installed in the platen, system could be applicable to other types of relative motion between the monitoring system and the substrate. For example, in some implementations, e.g., orbital motion, the optical access traverses different positions on the substrate, but does not cross the edge of the substrate. In such cases, the collected spectra can still be grouped, e.g., spectra can be collected at a certain frequency and spectra collected within a time period can be considered part of a group. The time period should be sufficiently long that five to twenty spectra are collected for each group.

Moreover, rather than collecting a group of spectra measurements for each sweep of an optical access across the substrate, the system could be configured such that just one spectrum is measured per sweep of an optical access across the substrate.

Furthermore, rather than using a bifurcated optical fiber to split the light from the light source, other optical elements, such as beam splitters, e.g., a half-silvered mirror, can be used to split the light from the light source or rejoin the light paths from the optical accesses to the optical detector. Also, rather than using optical fibers to carry the light from the light source and to the detector, other optical elements could be used to direct the light, e.g., mirrors. In addition, although the light source 162 and the detector 164 are illustrated as supported in the platen 120, the light source 162 and the detector 164 could be stationary elements that are not supported by the platen, e.g., a rotatory optical coupling could be used to connect the optical fibers in the platen to optical fibers that connect to the light source 162 and the detector 164.

In addition, the optical monitoring system could include a plurality of light sources, but the number of light sources could be less than the number of positions. In this case, light from one or more of the plurality of light sources could be split, e.g., with a bifurcated optical fiber or other optical element, and directed to different positions. Thus, each light source of the plurality of light sources could provide light to non-overlapping subsets of the plurality of positions.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in a machine-readable storage device, for execution by, or to control the operation of, data processing apparatus, e.g., a programmable processor, a computer, or multiple processors or computers. A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

The above described polishing apparatus and methods can be applied in a variety of polishing systems. Either the polishing pad, or the carrier heads, or both can move to provide relative motion between the polishing surface and the substrate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material.

Terms of relative positioning are used to describe relative orientation of the parts within the system; it should be understood that this does not imply any particular orientation relative to gravity and that in operation the polishing surface and substrate can be held in a vertical orientation or some other orientation.

Particular embodiments of the invention have been described. Other embodiments are within the scope of the following claims.

What is claimed is:

1. A polishing apparatus, comprising:

a platen to hold a polishing pad having a plurality of optical apertures;

a carrier head to hold a substrate against the polishing pad;

a motor to generate relative motion between the carrier head and the platen; and an optical monitoring system, the optical monitoring system including a plurality of light sources, each light source of the plurality of light sources being a white-light source configured to output substantially the same spectrum, a common detector, wherein the detector comprises a spectrometer, and an optical assembly configured to direct light from each light source of the plurality of light sources to a respective different position of a plurality of separated positions in the platen, there being an equal number of separated positions as light sources, to direct light from each position of the plurality of separated positions to the substrate as the substrate passes over said each position, to receive reflected light from the substrate as the substrate passes over said each position, and to direct the reflected light from each of the plurality of separated positions to the common detector.

2. The polishing apparatus of claim 1, wherein the platen is rotatable about an axis of rotation.

3. The polishing apparatus of claim 2, wherein the plurality of separated positions are spaced equidistant from the axis of rotation.

4. The polishing apparatus of claim 3, wherein the plurality of separated positions are spaced at equal angular intervals around the axis of rotation.

5. The polishing apparatus of claim 1, wherein the optical assembly is configured such that an angle of incidence of the light on the substate from said each position is identical.

6. The polishing apparatus of claim 1, wherein the plurality of separated positions consists of exactly three positions.

7. The polishing apparatus of claim 1, wherein the optical assembly includes a plurality of optical fibers, each optical fiber of the plurality of optical fibers having a first end connected to an associated light source of the plurality of light sources and a second end configured to direct light to an associated position of the plurality of separated positions.

8. The polishing apparatus of claim 7, wherein the optical assembly includes a bifurcated optical fiber having a trunk connected to the common detector and a plurality of branches, each branch of the plurality of branches configured to receive light from the associated position of the plurality of separated positions.

9. The polishing apparatus of claim 1, further comprising an optical switch configured to pass light from a selected one of the plurality of separated positions to the detector.

10. The polishing apparatus of claim 1, wherein the platen is configured such that relative motion between the carrier head and the platen causes each position of the plurality of separated positions to repeatedly sweep across the substrate.

11. The polishing apparatus of claim 10, further comprising a controller configured to receive a group of spectrum measurements from the detector for each sweep of each position across the substrate and generate a sequence of spectra.

12. The polishing apparatus of claim 11, wherein the controller is configured to determine at least one of a polishing endpoint or an adjustment to a polishing parameter based on the sequence of spectra.

13. The polishing apparatus of claim 1, wherein the optical assembly is configured such that light reaches only one of the plurality of separated positions at a time.

* * * * *